US005203693A

United States Patent [19]

Swanson

[11] Patent Number: 5,203,693

[45] Date of Patent: Apr. 20, 1993

[54] ROTARY DRUM DRYER HAVING INTERNAL FLIGHTS

[75] Inventor: Malcolm L. Swanson, Chickamauga, Ga.

[73] Assignee: Astec Industries, Inc., Chattanooga, Tenn.

[21] Appl. No.: 769,963

[22] Filed: Oct. 1, 1991

[51] Int. Cl.[5] ..... F27B 7/14

[52] U.S. Cl. ..... 432/110; 432/118; 432/115; 34/136

[58] Field of Search ..... 432/105, 108, 110, 111, 432/118, 119; 34/130, 135, 136

[56] References Cited

U.S. PATENT DOCUMENTS

| | | | |
|---|---|---|---|
| 2,939,693 | 6/1960 | Old et al. | 432/110 |
| 3,798,789 | 3/1974 | Thompson | 432/118 |
| 3,910,756 | 10/1975 | Henning | 432/118 |
| 3,950,861 | 4/1976 | Weiner et al. | 432/118 |
| 4,190,370 | 2/1980 | Brock et al. . | |
| 4,298,287 | 11/1981 | McCarter, III et al. . | |
| 4,300,837 | 11/1981 | Malbrunot . | |
| 4,318,620 | 3/1982 | Malipier et al. . | |
| 4,332,478 | 6/1982 | Binz . | |
| 4,480,922 | 11/1984 | Mendenhall . | |
| 4,738,539 | 4/1988 | Marconnet . | |
| 4,787,938 | 11/1988 | Hawkins . | |
| 4,797,002 | 1/1989 | Heap . | |
| 4,802,139 | 1/1989 | Sasaki . | |
| 4,867,572 | 9/1989 | Brock et al. . | |
| 4,988,207 | 1/1991 | Marconnet . | |
| 5,083,382 | 1/1992 | Brashears | 34/136 |

*Primary Examiner*—Henry C. Yuen

*Attorney, Agent, or Firm*—Bell, Seltzer, Park & Gibson

[57] ABSTRACT

A rotary drum dryer is disclosed which is useful in the production of asphalt paving composition. The drum incorporates a burner which defines a combustion zone, and a novel dam and flight construction is mounted to the interior of the drum so that the flights surround the combustion zone. The dam is adapted to retain and raise the level of the aggregate flowing through the rotating drum so that the flights pass through the aggregate in the bottom of the drum, and the flights collect a portion of the aggregate on their top surfaces and carry the collected aggregate to an elevated discharge point, where the aggregate drops back to the bottom of the drum. The flights serve to shield the metal wall of the drum from the radiant heat energy of the burner flame which would otherwise result in its rapid deterioration, and they also serve to permit the aggregate to be effectively exposed to the radiant heat. The fact that more radiant heat energy is transferred to the aggregate, serves to further lower the temperature of the metal wall of the drum. Still further, the fact that the flights pass through the aggregate and are covered by the aggregate through a substantial portion of their circular path of travel, results in the flights being exposed to less radiant heat energy and thus subject to less deterioration.

12 Claims, 3 Drawing Sheets

ROTARY DRUM DRYER HAVING INTERNAL FLIGHTS

BACKGROUND OF THE INVENTION

The present invention relates to a rotary drum dryer adapted for heating and drying stone aggregate useful in the production of asphalt paving composition or the like.

Conventional asphalt production plants include a drum dryer wherein the stone aggregate is heated and dried and then mixed with liquid asphalt. Such dryers typically comprise a rotating drum which is inclined from the horizontal. The virgin aggregate is introduced into the upper end of the drum, and an outlet is provided adjacent the lower end of the drum for withdrawing the heated and dried aggregate. A burner is mounted adjacent one end of the drum so as to create a heated gas stream which moves through the drum to heat the aggregate flowing therethrough.

In a parallel flow dryer, the burner is mounted adjacent the upper end of the drum so that the heated gas stream moves through the drum in a direction parallel to the moving aggregate, while in a counterflow drum dryer, the burner is mounted adjacent the lower end of the drum and the heated gas flows counter to the direction of movement of the aggregate. A dryer of the parallel flow type is disclosed in U.S. Pat. No. 4,332,478 to Binz, and a dryer of the counterflow type is disclosed in U.S. Pat. No. 4,867,572 to Brock et al.

In drum dryers of the described type, the burner flame defines a combustion zone, and a plurality of longitudinally extending flights extend about the circumference of the inside wall of the drum at the combustion zone, so that the flights shield the wall of the drum from the radiant heat of the burner flame and thereby protect the wall from overheating and deterioration. The need for a protective refractory lining is thus usually unnecessary. These flights are typically T-shaped in transverse cross section, and the flights are spaced from the wall so as to pass over the layer of aggregate in the bottom of the drum as the drum rotates. Thus the flights also tend to shield the aggregate from the radiant heat as the aggregate moves through the combustion zone.

As will be apparent, the above described flights are continually exposed to the radiant heat of the burner flame in the combustion zone, and as a result, the flights themselves become overheated and rapidly deteriorate. Further, the fact that the flights overlie and shield the aggregate in the bottom of the drum, tends to lower the heat absorbed by the aggregate.

It is accordingly an object of the present invention to provide a novel flight construction for the combustion zone of a rotary drum dryer of the described type and which serves to not only effectively shield the wall of the drum from the radiant energy, but also permits more of the aggregate to be exposed to the radiant energy to thereby increase the heat absorbed by the aggregate.

It is another object of the present invention to provide a novel flight construction for a rotary drum dryer of the described type and wherein the flights are covered by the aggregate during a substantial portion of their circular path of travel, and so that the aggregate is exposed to more of the radiant heat energy to increase its temperature, and while the flights are exposed to less radiant energy to decrease their temperature and thus reduce their deterioration.

SUMMARY OF THE PRESENT INVENTION

The above and other objects and advantages of the present invention are achieved in the embodiments illustrated herein by the provision of a rotary drum dryer which comprises an elongate hollow drum having a cylindrical wall which defines a central axis, and means mounting the drum for rotation about the central axis and with the central axis being inclined with respect to the horizontal so as to define an upper end and a lower end of the drum. An aggregate inlet is positioned adjacent the upper end of the drum for introducing aggregate into the interior of the drum, and an aggregate outlet is positioned adjacent the lower end of the drum for withdrawing the aggregate from the interior of the drum.

A drive motor is provided for rotating the drum about the central axis so as to cause the aggregate which is introduced at the inlet to move through the interior of said drum to the outlet. Also, a burner is positioned adjacent one of the ends of the drum for introducing a high temperature flame into the interior of the drum, and so as to define a combustion zone in the drum which surrounds said flame. An exhaust duct is positioned adjacent the other of the ends of the drum for exhausting the heated gas therefrom and so that the heated gas flows through said drum.

In accordance with the present invention, a dam coaxially encircles the inside of the wall of the drum and is located adjacent the downstream end of the combustion zone, with the dam defining an inside circumferential edge which is spaced from the wall of the drum. Also, a plurality of longitudinally extending flights are mounted to the inside surface of the wall of the drum and extend upstream from the dam along at least a substantial portion of the length of the combustion zone, with each of the flights, when viewed in transverse cross section, comprising a medial portion which is generally parallel to the adjacent portion of the inside circumferential edge of the dam, and a trailing edge portion which is inclined away from the wall. In operation, the dam acts to retain and raise the level of the aggregate flowing through the combustion zone of the rotating drum so that the flights pass through the aggregate in the bottom of the drum. Also, the flights collect a portion of the aggregate on their top surfaces and carry the collected aggregate to an elevated discharge point.

In the preferred embodiment, each of the flights further includes a leading edge portion which is inclined toward the wall of the drum at an angle of about 30 degrees, and the trailing edge portion extends upwardly from the wall of the drum at an angle of about 70 degrees. Further, the flights are equally spaced about the entire circumference of the inside surface of the drum, so as to shield substantially the entire area of the inside surface from the radiant heat of the burner flame.

BRIEF DESCRIPTION OF THE DRAWINGS

Some of the objects and advantages of the present invention having been stated, others will appear as the description proceeds, when taken in conjunction with the accompanying schematic drawings in which.

DETAILED DESCRIPTION OF THE PREFERRED EMBODIMENTS

Figure 1:
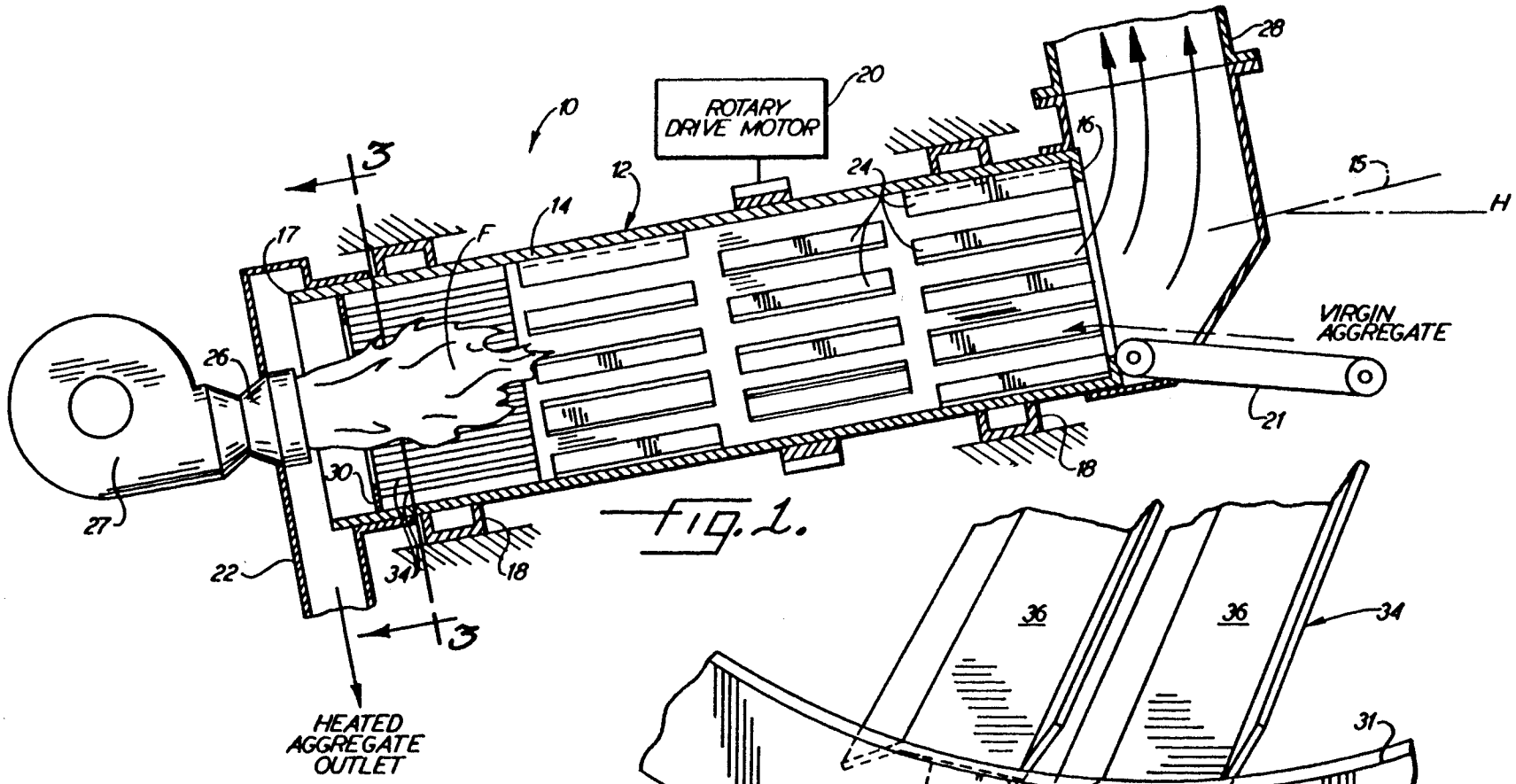
FIG. 1 is a partially sectioned side elevation view of a rotary drum dryer which embodies the features of the present invention.

Referring more particularly to the drawings, FIG. 1 schematically illustrates a rotary drum dryer 10 in accordance with one preferred embodiment of the present invention. The dryer 10 comprises an elongate hollow drum 12 having a cylindrical wall 14, and which defines a central axis 15 which is inclined with respect to the horizontal H so as to define an upper end 16 and a lower end 17 of the drum.

The drum 12 is rotatably mounted on a frame by means of bearing sleeves 18 and so as to be rotatable about the central axis 15. A motor which is shown schematically in FIG. 1 at 20 rotates the drum about the central axis in a conventional manner. An aggregate delivery conveyor 21 is positioned adjacent the upper end of the drum for introducing stone aggregate or the like into the interior of drum, and an aggregate outlet duct 22 is positioned at the lower end of the drum.

A plurality of lifting flights 24 of conventional design are mounted on the inside of the drum and along the major portion of the axial length of the drum for lifting the aggregate and dropping the same through the interior of the dryer as it is rotated. Thus the aggregate which is introduced into the drum via the inlet conveyor 21 is caused to cascade through the interior of the drum, and move toward the outlet duct.

The drum dryer further includes a burner 26 which is mounted at the lower end of the drum for directing a high temperature flame into the interior of the drum. The burner 26 is of conventional design, and it includes a blower 27 which charges a mixture of fuel and air into the burner, where it is ignited to produce a flame for heating the interior of the drum. An exhaust air duct 28 is positioned at the upper end of the drum, for exhausting the heated gases from the drum and so that the heated gas flows through the drum to heat the cascading aggregate. The exhaust air flow may be conveyed through the duct to a conventional filtering baghouse (not shown) and then released to the atmosphere.

The flame F of the burner defines a combustion zone in the drum which surrounds at least a substantial portion of the length of the flame, and in accordance with the present invention, a dam 30 is mounted to the inside wall of the drum in a coaxially encircling manner adjacent the downstream end of the combustion zone. The dam 30 comprises a plurality of aligned and interconnected metal plates, and it defines an inside circumferential edge 31 which is spaced from the wall of the drum. Also, in the illustrated embodiment, all of the plates of the dam 30 include an opening 32 adjacent the inside surface of the wall of the drum, to facilitate cleaning of the aggregate therefrom.

Figure 2:
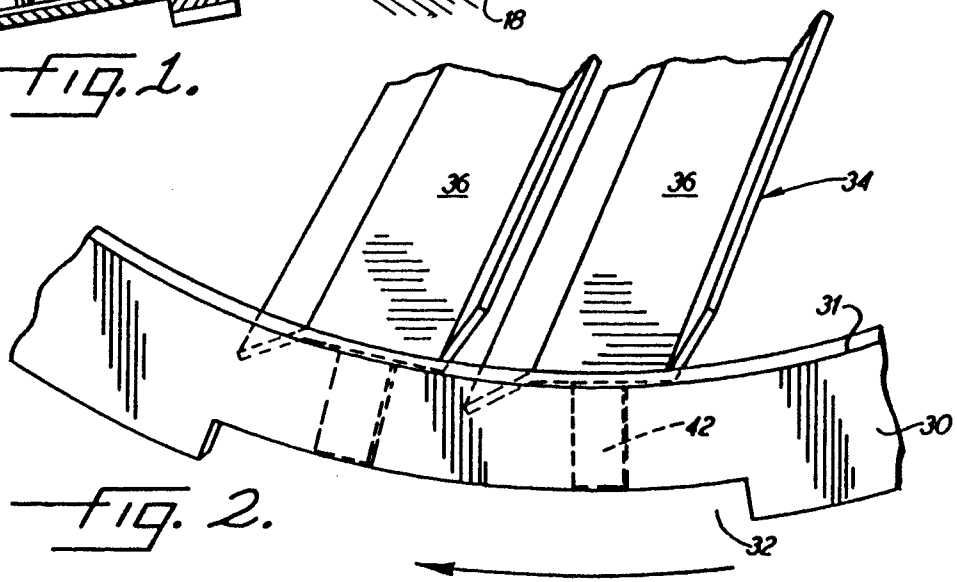
FIG. 2 is an enlarged fragmentary perspective view of the flights and dam located in the drum of FIG. 1.
Figure 4:
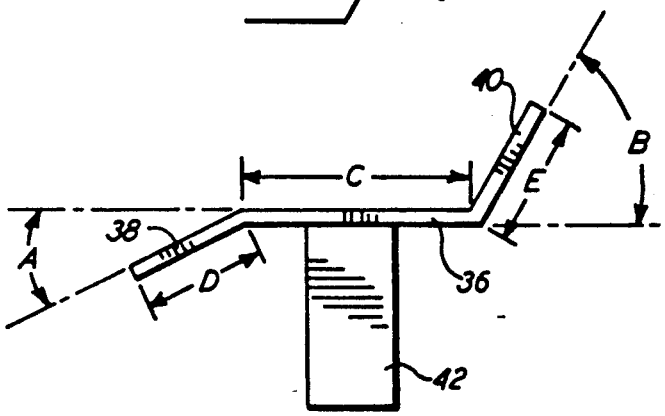
FIG. 4 is a fragmentary side elevation view of one of the flights of the present invention.

Also in accordance with the present invention, a plurality of longitudinally extending flights 34 are mounted to the inside surface of the wall of the drum and so as to extend upstream from the dam along at least a substantial portion of the length of the combustion zone. Each of the combustion zone flights 34, when viewed in transverse cross section as seen in FIG. 4, comprises a generally planar medial portion 36 having opposite side edges, a leading edge portion 38 extending from the leading side edge of the medial portion when viewed in the rotational direction of the drum, and a trailing edge portion 40 extending from the other side edge. In the illustrated embodiment, the medial portion 36 defines a plane which is substantially perpendicular to a radial line extending from the central axis 15, and the medial portion 36 is aligned with the adjacent portion of the circumferential edge 31 of the dam 30 as best seen in FIG. 2. Also, the leading edge portion 38 and the trailing edge portion 40 each have a transverse dimension which is about one half that of the medial portion, and the leading edge portion 38 extends downwardly toward the wall of the drum at an angle A of about 30° from the plane of the medial portion, and the trailing edge portion 40 extends upwardly from the plane of the medial portion at an angle B of about 70°.

Figure 3:
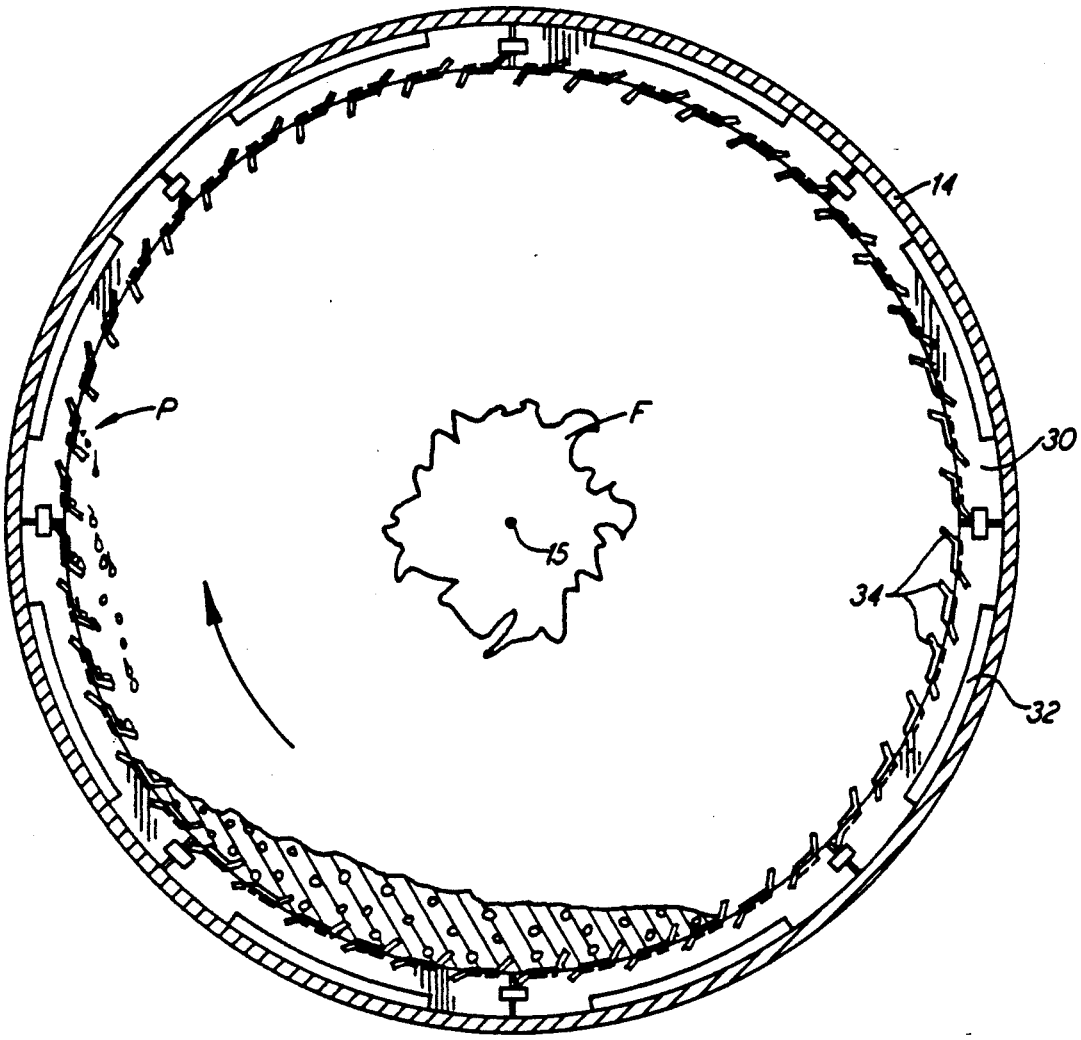
FIG. 3 is an enlarged sectional view taken substantially along the line 3—3 of FIG. 1.

The flights 34 are equally spaced about the entire circumference of the inside surface of the wall of the drum, and they are mounted to the drum by means of the posts 42. More particularly, the posts 42 comprise an angled metal member, and three or four of such posts are positioned in a longitudinally spaced apart arrangement along the length of each flight for mounting the flight to the wall of the drum. As best seen in FIG. 3, the flights 34 are positioned sufficiently close to each other so that the inside wall of the drum is substantially completely covered in the radial direction. Thus the wall of the drum is substantially completely shielded from the radiant heat of the flame F in the combustion zone.

In a typical installation, the drum has a diameter of about eight feet and a longitudinal length of about forty feet. Also, the combustion zone flights 34 have a longitudinal length of about ten feet, and the medial portions have a width C (FIG. 3) of about six inches. The leading edge portion 38 of each flight has a width D of about three inches, and the trailing edge portion 40 of each flight has a width E of about three inches. The dam 30 has a radial height of about six inches.

In operation, the aggregate is continuously introduced into the upper end of the rotating drum by the inlet conveyor 21, and the aggregate cascades through the interior of the drum and moves toward the outlet duct 22 at the lower end 17. Also, with the burner 26 in operation, heated gases flow through the length of the drum in a direction counter to the direction of movement of the aggregate and exhausts through the outlet duct 28 to the filtering baghouse.

The dam 30 is located adjacent the downstream end of the combustion zone when viewed in the direction of movement of the aggregate, and it serves to retain the aggregate in the combustion zone and to cause the level of the aggregate to rise so that the flights move through the aggregate which is in the bottom of the drum, note FIG. 3. Stated in other words, the level of the aggregate in the bottom of the drum is above the flights 34, and thus the aggregate is directly exposed to the radiant heat from the flame. As the flights lift from the aggregate in the bottom of the rotating drum, a portion of the aggregate is retained by the upstanding trailing edge portions 40 of the flights, and this retained aggregate is lifted to a discharge point P, which as seen in FIG. 3, is about 150° from the opposite edge of the aggregate layer in the bottom of the drum. Thus the aggregate is exposed to the radiant energy through nearly one-half of the arc of the drum.

It will also be understood that since the flights 34 extend below the level of the aggregate in the bottom of the drum, and are covered by retained aggregate on their top surfaces along another portion of their circular path of travel, the flights 34 are shielded from exposure to the radiant heat energy for a significant portion of their circular travel. This results in the flights being cooler, which in turn reduces warpage or other deterioration of the flights. Also, it will be understood that the temperature of the drum wall 14 and the resulting metal deterioration of the wall are also reduced, since more of the radiant heat energy is transferred directly to the aggregate.

Figure 5:
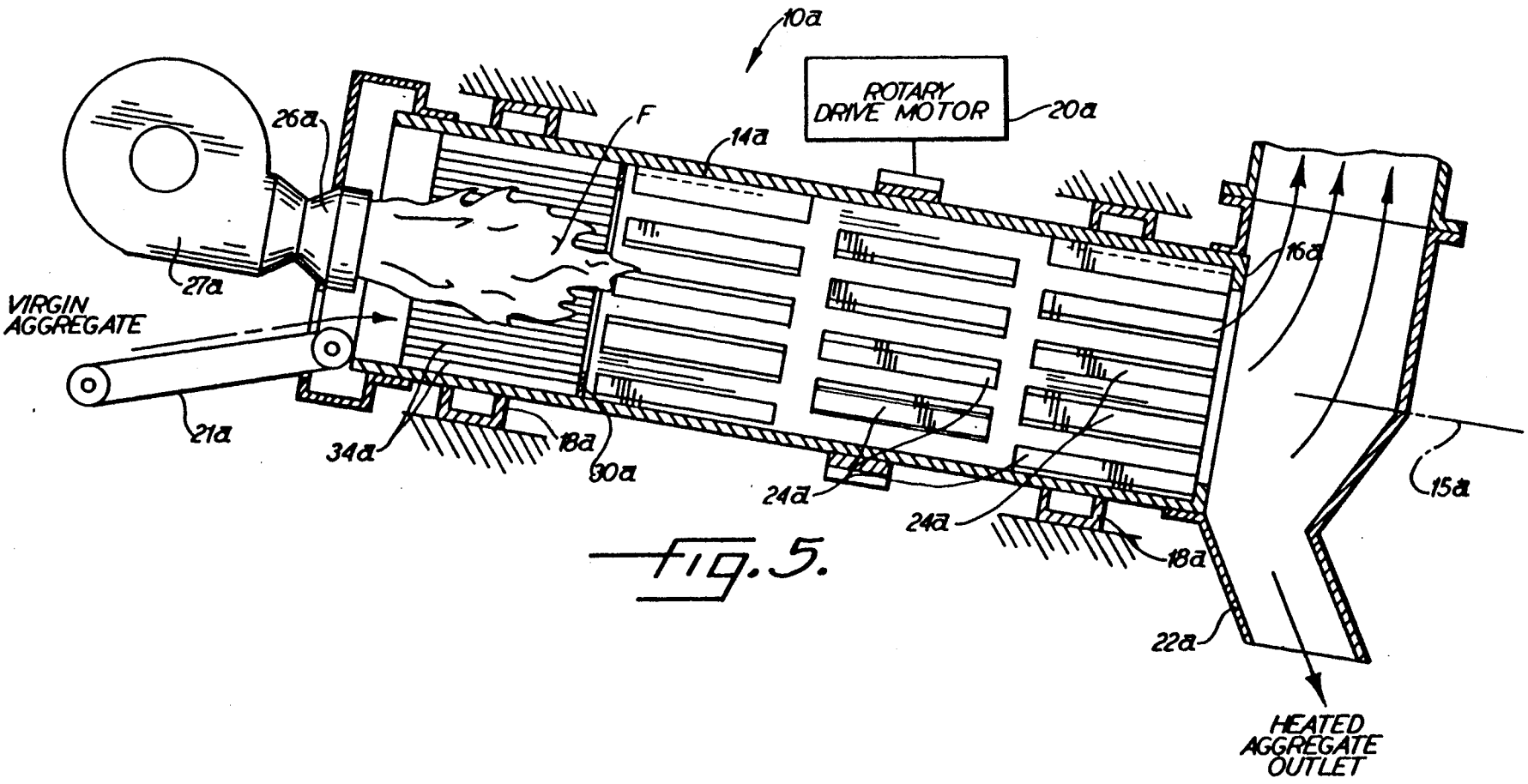
FIG. 5 is a view similar to FIG. 1 but illustrating a drum dryer of the parallel flow type and which embodies the present invention.

In the embodiment of FIG. 5, the rotatable drum dryer 10*a* is similarly mounted for rotation about an axis 15*a* which is inclined with respect to the horizontal, with the aggregate inlet conveyor 21*a* being positioned adjacent the upper end of the dryer and the aggregate outlet duct 22*a* being positioned adjacent the lower end of the dryer. In this embodiment however, the burner 26*a* is disposed adjacent the upper end of the drum so that the aggregate moves through the drum in a direction parallel to the direction of gas flow through the drum. Also, this embodiment incorporates essentially the same lifting flights 24*a*, dam 30*a*, and combustion zone flights 34*a*, as in the embodiment of FIGS. 1–4, and the operation of the dam 30*a* and flights 34*a* is essentially the same as that described in the initial embodiment.

In the drawings and specification there has been set forth a preferred embodiment of the invention, and although specific terms are employed, they are used in a generic and descriptive sense only and not for purposes of limitation.

That which is claimed is:

1. A rotary drum dryer adapted for heating and drying stone aggregate useful in the production of asphalt paving composition or the like, and comprising an elongate hollow drum having a cylindrical wall which defines a central axis, means mounting said drum for rotation about said central axis and with said central axis being inclined with respect to the horizontal so as to define an upper end and a lower end of said drum, aggregate inlet means positioned adjacent said upper end of said drum for introducing aggregate into the interior of said drum, and aggregate outlet means positioned adjacent said lower end of said drum for withdrawing the aggregate from the interior of said drum, and so as to define a downstream direction from the inlet means toward the outlet means and an opposite upstream direction, means for rotating said drum about said central axis so as to cause the aggregate which is introduced at said inlet means to move through the interior of said drum in the downstream direction to said outlet means, heating means comprising a burner positioned adjacent one of said ends of said drum for introducing air and a high temperature flame into the interior of said drum, and so as to define a combustion zone in said drum which surrounds said flame, exhaust duct means positioned adjacent the other of said ends of said drum for exhausting the heated gas therefrom and so that the heated gas flows through said drum, a dam coaxially encircling the inside surface of said wall of said drum and located adjacent the downstream end of said combustion zone, with said dam defining an inside circumferential edge which is spaced from said wall of said drum, a plurality of longitudinally extending flights mounted to the inside surface of said wall of said drum and extending upstream from said dam along at least a substantial portion of the length of said combustion zone, with each of said flights, when viewed in transverse cross section, comprising a medial portion which is generally parallel to the adjacent portion of said inside circumferential edge of said dam, and a trailing edge portion which is inclined away from the wall of said drum, whereby the dam is adapted to retain and raise the level of the aggregate flowing through the combustion zone of the rotating drum so that the flights pass through the aggregate in the bottom of the drum, and the flights collect a portion of the aggregate on their top surfaces and carry the collected aggregate to an elevated discharge point.

2. The rotary drum dryer as defined in claim 1 wherein said flights are equally spaced about the entire circumference of the inside surface of said cylindrical wall of said drum.

3. The rotary drum dryer as defined in claim 2 wherein said flights are positioned sufficiently close to each other so that the inside surface of said cylindrical wall is substantially completely covered in the radial direction.

4. The rotary drum dryer as defined in claim 2 wherein said medial portion of each of said flights is generally planar and defines a plane which is substantially perpendicular to a radial line extending from said central axis.

5. The rotary drum dryer as defined in claim 4 wherein said trailing edge portion of each of said flights extends from said plane of said medial portion at an angle of about 70 degrees.

6. The rotary drum dryer as defined in claim 5 wherein each of said flights further comprises a leading edge portion which is positioned on the side of said medial portion opposite said trailing edge portion, and wherein said leading edge portion is inclined toward the wall of said drum and extends from said plane of said medial portion at an angle of about 30 degrees.

7. The rotary drum dryer as defined in claim 3 wherein said medial portion of said flights, when viewed in transverse cross section, lies at a level which generally corresponds to the level of the adjacent portion of said inside circumferential edge of said dam.

8. The rotary drum dryer as defined in claim 1 wherein said dam comprises a plurality of aligned and interconnected plates, and a plurality of openings extending through at least some of said plates immediately adjacent the inside surface of said wall of said drum to facilitate cleaning of the aggregate therefrom.

9. The rotary drum dryer as defined in claim 1 wherein said heating means is disposed adjacent said lower end of said drum so that the aggregate moving through said drum in the downstream direction moves counter to the direction of gas flow through said drum.

10. The rotary drum dryer as defined in claim 1 wherein said heating means is disposed adjacent said upper end of said drum so that the aggregate moving through said drum in the downstream direction moves parallel to the direction of gas flow through said drum.

11. The rotary drum dryer as defined in claim 1 further comprising lifting flight means mounted to that portion of said inside surface of said wall of said drum which is outside of said combustion zone for lifting and cascading the aggregate as it flows in the downstream direction through the interior of the rotating drum.

12. The rotary drum dryer as defined in claim 1 wherein said flights are supported in spaced relation from the inside surface of said wall of said drum by a plurality of longitudinally spaced apart posts.

* * * * *